US006761571B2

(12) United States Patent
Hida

(10) Patent No.: US 6,761,571 B2
(45) Date of Patent: Jul. 13, 2004

(54) COAXIAL CONNECTOR WITH A SWITCH

(75) Inventor: Kohei Hida, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/270,013

(22) Filed: Oct. 15, 2002

(65) Prior Publication Data

US 2003/0077931 A1 Apr. 24, 2003

(30) Foreign Application Priority Data

Oct. 18, 2001 (JP) ..... 2001-320607

(51) Int. Cl.[7] ..... H01R 29/00
(52) U.S. Cl. ..... 439/188; 439/63; 439/944
(58) Field of Search ..... 439/188, 581, 439/944, 63; 200/51.1

(56) References Cited

U.S. PATENT DOCUMENTS 2,790,733 A 2/1957 Pohl
3,878,347 A 4/1975 Roeser
4,630,015 A 12/1986 Gernhardt et al.
5,741,146 A 4/1998 Henry et al.
6,068,492 A * 5/2000 Uratani et al. ..... 439/63
6,099,334 A * 8/2000 Togashi ..... 439/188
6,554,630 B2 * 4/2003 Uratani ..... 439/188

FOREIGN PATENT DOCUMENTS

| | | |
|---|---|---|
| EP | 1037330 | 9/2000 |
| EP | 1115183 | 7/2001 |
| JP | 10-3968 | 1/1998 |
| JP | 10-208817 | 8/1998 |

* cited by examiner

*Primary Examiner*—Hae Moon Hyeon
(74) *Attorney, Agent, or Firm*—Kanesaka & Takeuchi

(57) ABSTRACT

A coaxial connector with a switch comprises an insulative housing (22) having an opening (35), an outer conductor (23) provided outside the insulative housing (22), a fixed terminal (24) having a contact portion (40), and a movable terminal (25) having a fixed portion (42) and a cantilevered flexible portion (44). The flexible portion (44) has at least one cut-off portion (47). When a central conductor (29) of a coaxial plug (26) is plugged into the opening (35), the flexible portion (44) separates from the contact portion (40) to switch a signal circuit.

6 Claims, 10 Drawing Sheets

COAXIAL CONNECTOR WITH A SWITCH

BACKGROUND OF THE INVENTION

1. Field of the Invention

The present invention relates to a coaxial connector mounted on a circuit board and, especially, to a coaxial connector having a switch for switching a high-frequency signal circuit.

2. Description of the Related Art

A coaxial connector having a switch is widely used for testing a high-frequency circuit in a portable communication equipment, such as a portable telephone. Such a coaxial connector is described in Japanese Patent Application Kokai Nos. 10-208817 and 10-3968.

FIGS. 11 and 12 show a coaxial connector having a switch disclosed in JP 10-208817. The coaxial connector comprises an insulative housing 2 having an insertion hole 3, an outer conductor 3 provided outside the insulative housing 2, and a pair of fixed and movable terminals 5 and 6 provided in a space 4 communicating with the insertion hole 1. The movable terminal 6 comprises a zigzag portion 7 and a substantially U-shaped contact portion 8. As shown in FIG. 11, when a central conductor 9 of a probe is not plugged into the insertion hole 1, the contact portion 8 of the movable terminal 6 is pressed against the fixed terminal 5 by the elastic force of the zigzag portion 7 so that the fixed and movable terminals 5 and 6 are electrically connected. However, as shown in FIG. 12, when the central conductor 9 of the probe is plugged into the insertion hole 1, the contact portion 8 of the movable terminal 6 flexes outwardly (downwardly in the drawing) to separate from the fixed terminal 5 so that the fixed and movable terminals 5 and 6 are electrically disconnected.

FIGS. 13 and 14 show a coaxial connector having a switch disclosed in JP 10-3968. The coaxial connector comprises an insulative housing 12 having a cavity 11, an outer conductor 13 provided outside the insulative housing 12, a pair of fixed and movable terminals 14 and 15 provided in the cavity 11, and an elastic member 15 provided under the movable terminal 16. As shown in FIG. 13, when a coaxial plug 17 is not inserted into the cavity 11, the movable terminal 15 is pressed against the fixed terminal 14 by the elastic forces of the movable terminal 15 itself and the elastic member 16 so that the fixed and movable terminals 14 and 15 are electrically connected. However, as shown in FIG. 14, when a central conductor 18 of the plug 17 is inserted into the cavity 11, the movable terminal 15 is pressed down by the central conductor 18 to elastically deform so that the fixed and movable terminals 14 and 15 are electrically disconnected.

However, the coaxial connector according to JP 10-208817 obtains a desired elastic force by providing the zigzag portion 7, and, therefore, the transmission line is made long so that the impedance is mismatched, thus making it difficult to improve the electrical characteristics. In addition, since the movable terminal 6 has a complicated shape, it is difficult to miniature the product and the manufacturing process requires a long period of time.

The coaxial connector according to JP 10-3968 has the problem that the stress is concentrated only on a fixed portion 19 of the movable terminal 15 during the flexure and deformation of the movable terminal 15, and, therefore, it is difficult to obtain a desired elastic force only by the movable terminal 15. Accordingly, the elastic member 16 is separately provided so that the number of parts is increased, the assembly work is difficult, and it is difficult to minimize the size of the product. In addition, electric current sometimes flows in the elastic member 16, which provides adverse effects on the high-frequency characteristics

SUMMARY OF THE INVENTION

Accordingly, it is an object of the present invention to provide a coaxial connector with a switch, which makes not only the manufacturing work easy but also the product small, and has the improved high-frequency characteristics.

According to an aspect of the invention, a coaxial connector with a switch mounted on a board comprises an insulative housing having an opening for receiving a central conductor of a coaxial plug from upside, an outer conductor provided outside the insulative housing and engaging with an outer conductor of the coaxial plug such that the plug is attached to or detached from the coaxial connector, a fixed terminal provided under the opening and having a contact portion, and a movable terminal provided under the opening and having a fixed portion fixed to the insulative housing and a cantilevered flexible portion extending from the fixed portion and contacting with the contact portion of the fixed terminal. When the central conductor of the coaxial plug is plugged into the opening of the insulative housing, the central conductor of the coaxial plug abuts against the flexible portion so that the flexible portion separates from the contact portion of the fixed terminal to switch a signal circuit. The flexible portion has at least one cut-off portion at a position located on a side of the fixed portion with respect to an abutting position with the central conductor of the coaxial plug.

The flexible portion, preferably, comprises side faces between which the distance increases from a vicinity of the abutting position toward the fixed portion of the movable terminal and the cut-off portion has a shape formed along the side faces. The cut-off portion, preferably, has a substantially triangular shape.

Alternatively, the side faces are curved from the vicinity of the abutting position toward the fixed portion of the movable terminal in a concave form.

According to another aspect of the invention, a coaxial connector with a switch mounted on a board comprises an insulative housing having an opening for receiving a central conductor of a coaxial plug from upside, an outer conductor provided outside the insulative housing and engaging with an outer conductor of the coaxial plug such that the plug is attached to or detached from the coaxial connector, a fixed terminal provided under the opening and having a contact portion, and a movable terminal provided under the opening and having a fixed portion fixed to the insulative housing and a cantilevered flexible portion extending from the fixed portion and contacting with the contact portion of the fixed terminal. When the central conductor of the coaxial plug is plugged into the opening of the insulative housing, the central conductor of the coaxial plug abuts against the flexible portion so that the flexible portion separates from the contact portion of the fixed terminal to switch a signal circuit. The flexible portion has side faces curved from a vicinity of an abutting position with the central conductor of the coaxial plug toward the fixed portion of the movable terminal in a concave form.

It is preferable that each of the side faces of the flexible portion is formed by a quarter circular arc having a diameter of substantially ½ to 2 times of a difference between a width of the flexible portion at the vicinity of the abutting position of the movable terminal and a width of the fixed portion of the movable terminal.

According to a still another aspect of the invention, a coaxial connector with a switch mounted on a board comprises an insulative housing having an opening for receiving a central conductor of a coaxial plug from upside, an outer conductor provided outside the insulative housing and engaging with an outer conductor of the coaxial plug such that the plug is attached to or detached from the coaxial connector, a fixed terminal provided under the opening and having a contact portion and a fixed portion, and a movable terminal provided under the opening and having a fixed portion fixed to the insulative housing and a cantilevered flexible portion extending from the fixed portion and contacting with the contact portion of the fixed terminal. The fixed portions of the fixed and movable terminals have substantially same width which is greater than a width of the flexible portion of the movable terminal, and at least one of the fixed and movable terminals comprises an arm portion to cover a space on both sides of the flexible portion.

With the above structure, the stress on the movable terminal during the flexure and deformation of the movable terminal is widely distributed and reduced, and, therefore, the durability of the movable terminal is increased.

DESCRIPTON OF THE PERFERRED EMBODIMENTS

Embodiments of the invention will now be described with reference to the accompanying drawings.

Figure 1:
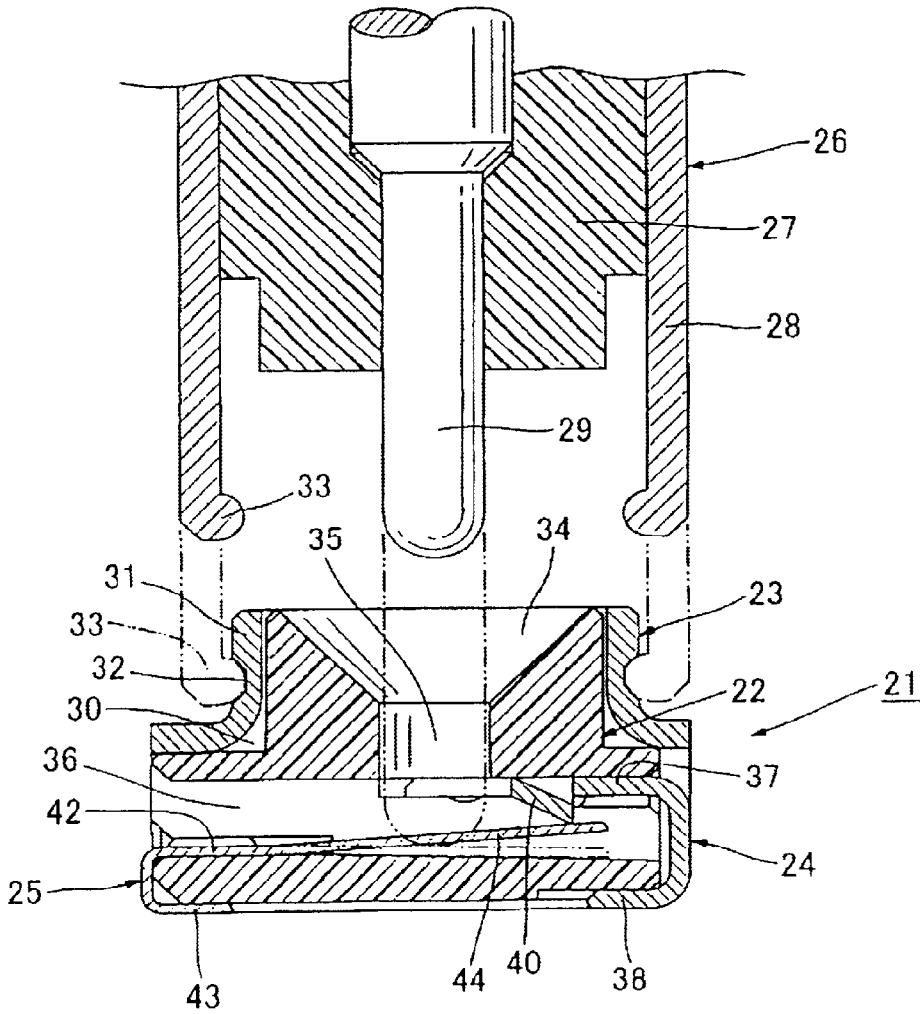
FIG. 1 is a sectional view of a coaxial connetor and a coaxial plug according to an embodiment of the invention.
Figure 2:
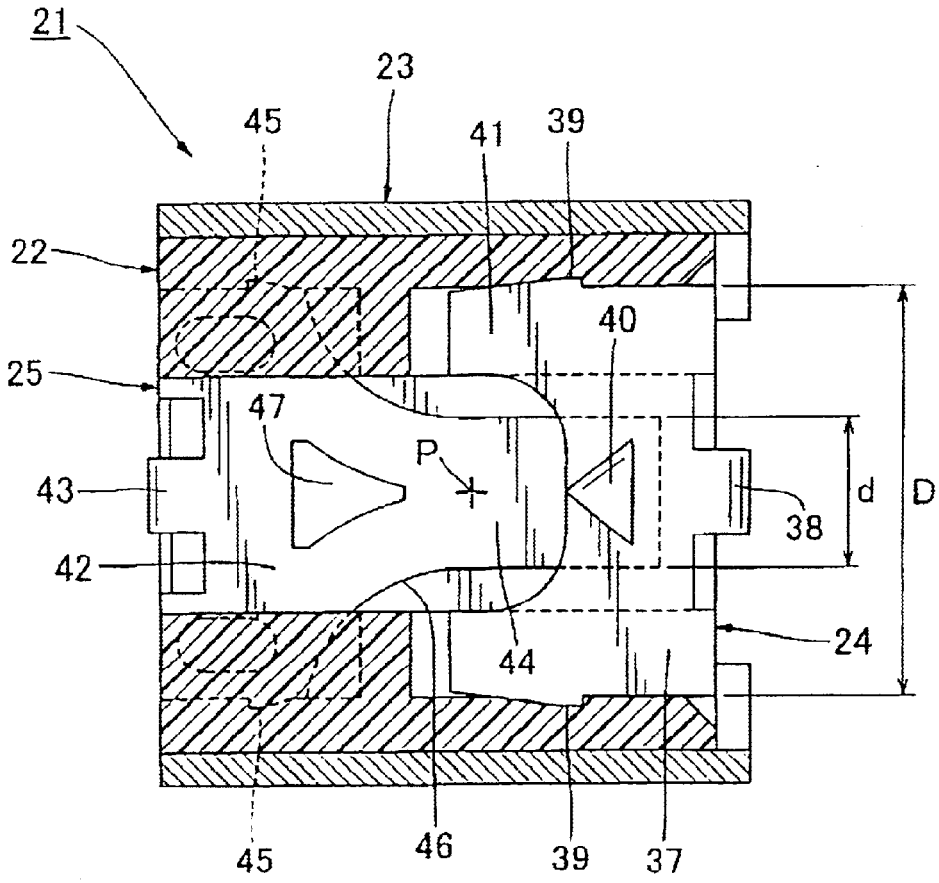
FIG. 2 is a sectional view of the coaxail connector taken in a horizontal plane.
Figure 3:
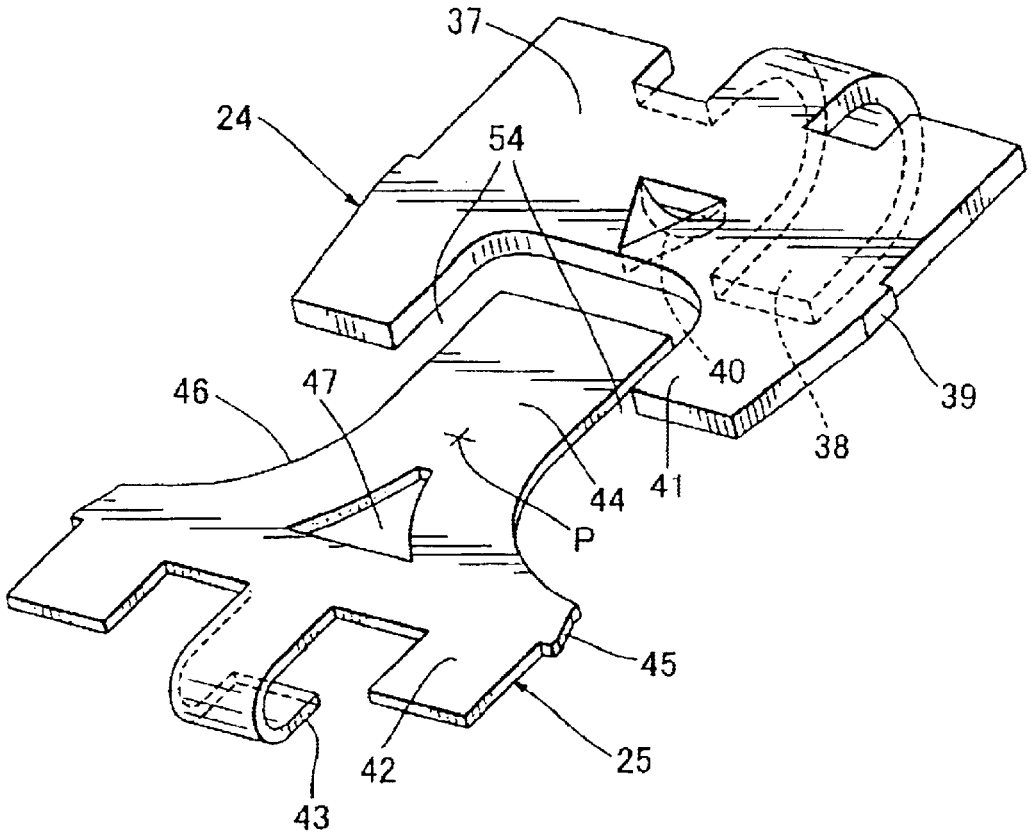
FIG. 3 is a perspective view of fixed and movable terminals according to the embodiment of the invention.

In FIG. 1, a coaxial connector 21 with a switch according to an embodiment of the present invention comprises an insulative housing 22 of a substantially rectangular parallelepiped, an outer conductor 23 provided outside the insulative housing 22, a fixed terminal 24, and a movable terminal 25 having a maximum width substantially equal to that of the fixed terminal 24. The coaxial connector 21 is designed to be mounted on a circuit board (not shown), and a coaxial plug 26 is plugged into or unplugged from the coaxial connector 21. The coaxial plug 26 comprises an insulative housing 27 of a substantially cylindrical shape, an outer conductor 28 provided outside the insulative housing 27, and a central conductor 29 provided along a central axis of the insulative housing 27. The outer and central conductors 28 and 29 protrude downwardly from the insulative housing 27 and are displaceable in the upward direction.

A circular-form stepped portion 30 is provided at an upper part of the insulative housing 22 along a periphery of the insulative housing 22. An upper portion 31 of the outer conductor 23 is curved such that the outer conductor 23 covers the stepped portion 30. An annular groove 32 having a semicircular shape in section is provided in an outer surface of the upper portion 31 of the outer conductor 23 such that a lower end portion 33 of the outer conductor 28 of the coaxial plug 26 engages with the annular groove 32. A dent 34 having a cone-shape is provided in an upper surface of the housing 22 and a pit 35 is provided in the center of a bottom surface of the dent 34. A space 36 is provided under the pit 35, which is long sideways and communicates with the pit 35 so that when the coaxial plug 26 is plugged, a lower end portion of the central conductor 29 passes through the pit 35 and reaches the space 36.

The fixed terminal 24 comprises a plate-shaped fixed portion 37 and a connection portion 38 which extends from a base end of the fixed portion 37 and bent downwardly in a U-shape to be connected to the circuit board. The connection portion 38 is provided at such a position that it does not prevent the movement of the outer conductor 29 in the axial direction. A pair of wedge-shaped projection 39 are provided on opposite sides of the fixed portion 37 so that the fixed portion 37 is press-fitted into the space 36 from side of the insulative housing 22 in the horizontal direction. A contact portion 40 is provided substantially in the center of the fixed portion 37 and projects downwardly. The contact portion 40 is made by cutting the base of a equilateral triangle and pressing the triangle downwardly. The contact portion 40 determines the contact position with a flexible portion 44 of the movable terminal 25 described hereinafter. A pair of arm portions 41 are provided on front sides of the fixed portion 37 such that the arm portions 41 cover spaces 54 on opposite sides of the flexible portion 44. Consequently, the horizontal distances from the outer conductor 23 to the fixed terminal 24 and to the movable terminal 25 are substantially equal to each other, thus achieving a good high-frequency property.

The movable terminal 25 comprises a fixed portion 42 of a plate-shape, a board connection portion 43 extending from a base side of the fixed portion 42 and bent downwardly in a U-shape, and the flexible portion 44 extending slightly upwardly from the fixed portion 42 in a cantilevered form. The flexible portion 44 is abutted with the central conductor 29 at a position P and contacted with a lower surface of the contact portion 40 at a position located on a side of a top end thereof with respect to the point P. A pair of wedge-shaped projections 45 are provided on opposite sides of the fixed portion 42 so that the fixed portion 42 is press-fitted into the space 36 from the opposite side of the fixed terminal 24 in the horizontal direction. Side faces 46 of the flexible portion 44 are spaced increasingly from the vicinity of the point P toward the fixed portion 42, forming concave curves. When the difference between a width (d) of the flexible portion 44 at the vicinity of the point (P) and a distance (D) of the fixed portion 42 of the movable terminal 25 is defined as L, the curvature of the side faces 46 is preferably equal to a quarter of a circle having a diameter of substantially ½ to 2 times of L. More preferably, the curvature is a quarter of a circle having a diameter of substantially L. A cut-off portion 47 is provided in the flexible portion 44 at a position on a side of the fixed portion 42 with respect to the point P. The cut-off portion 47 extends along the flexible portion 44 and has preferably a substantially triangle shape along the side faces 46.

How to plug or unplug the coaxial plug 26 into or from the coaxial connector 21 will be described.

In FIG. 1, when the coaxial plug 26 is not plugged into the coaxial connector 21, the flexible portion 44 of the movable terminal 25 is pressed against the contact portion 40 of the fixed terminal 24 so that the fixed and movable terminals 24 and 25 are electrically connected.

When the coaxial plug 26 is plugged, the low end portion 33 of the outer conductor 28 engages with the annular groove 32 and a low end portion of the central conductor 29 is inserted into the pit 35. When the coaxial plug 26 is further pressed downwardly, the outer conductor 28 is shrunk against its elastic force and the central conductor 29 projects from the outer conductor 28 so as to abut against the flexible portion 44 at the point P. Since the elastic force of the central conductor 29 is stronger than that of the flexible portion 44, the flexible portion 44 is pressed down by the central conductor 44 as shown by an imaginary line in FIG. 1 and deformed to separate from the contact portion 40 so that the fixed and movable terminals 24 and 25 are electrically disconnected.

Figure 4:
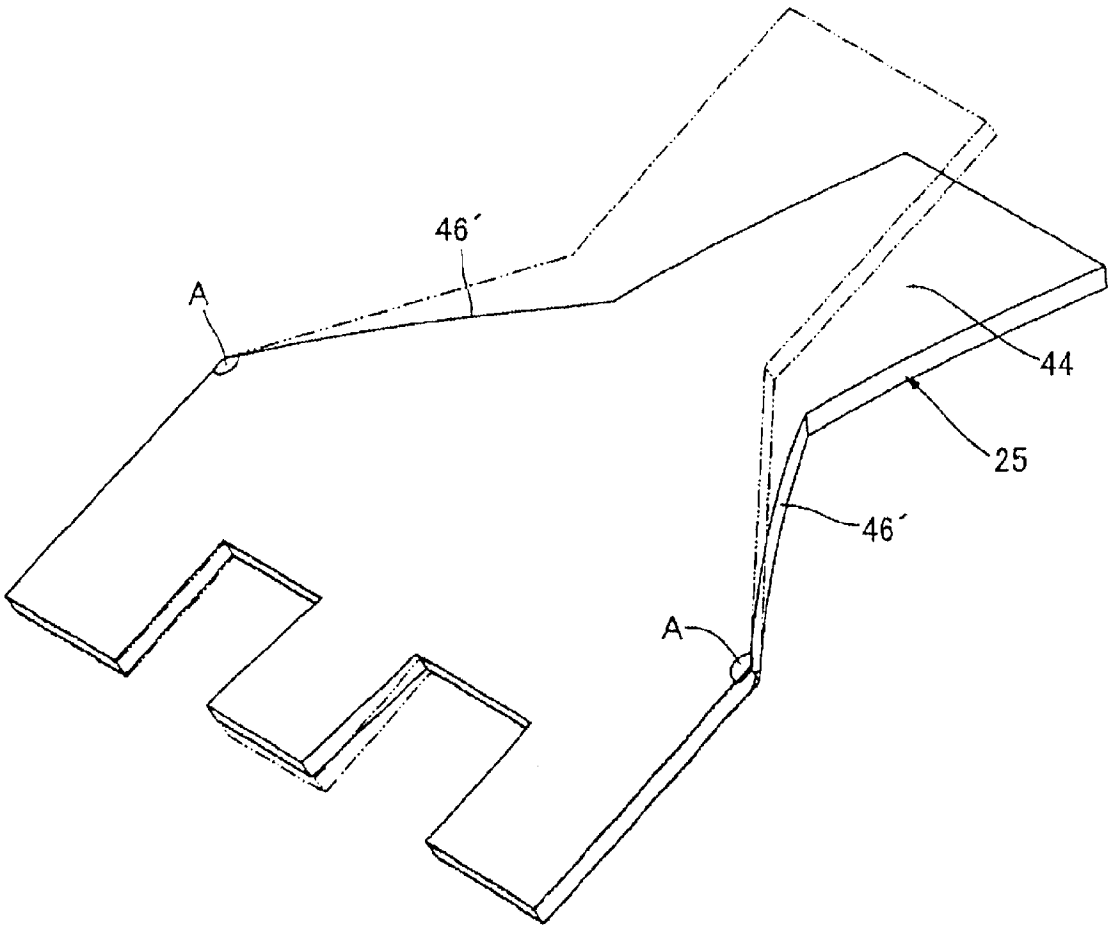
FIG. 4 is a perspective view of the movable terminal having straight side faces showing stress distributions.

In FIG. 4, when the flexible portion 44 is elastically deformed, the relatively high stress is concentrated on areas A, or base edges of side faces 46', where the side faces 46' are made diagonally straight. The maximum stress reaches $4.8\times10^3$N/mm$^2$. When the side faces 46 are curved from the vicinity of the point P toward the fixed portion 42 in a concave form, the stress is decreased. When the side faces 46 have a curvature of the quarter circular arc with a diameter of ½ to 2 times of L, the maximum stress becomes less than a half of that of the case shown in FIG. 4.

Figure 5:
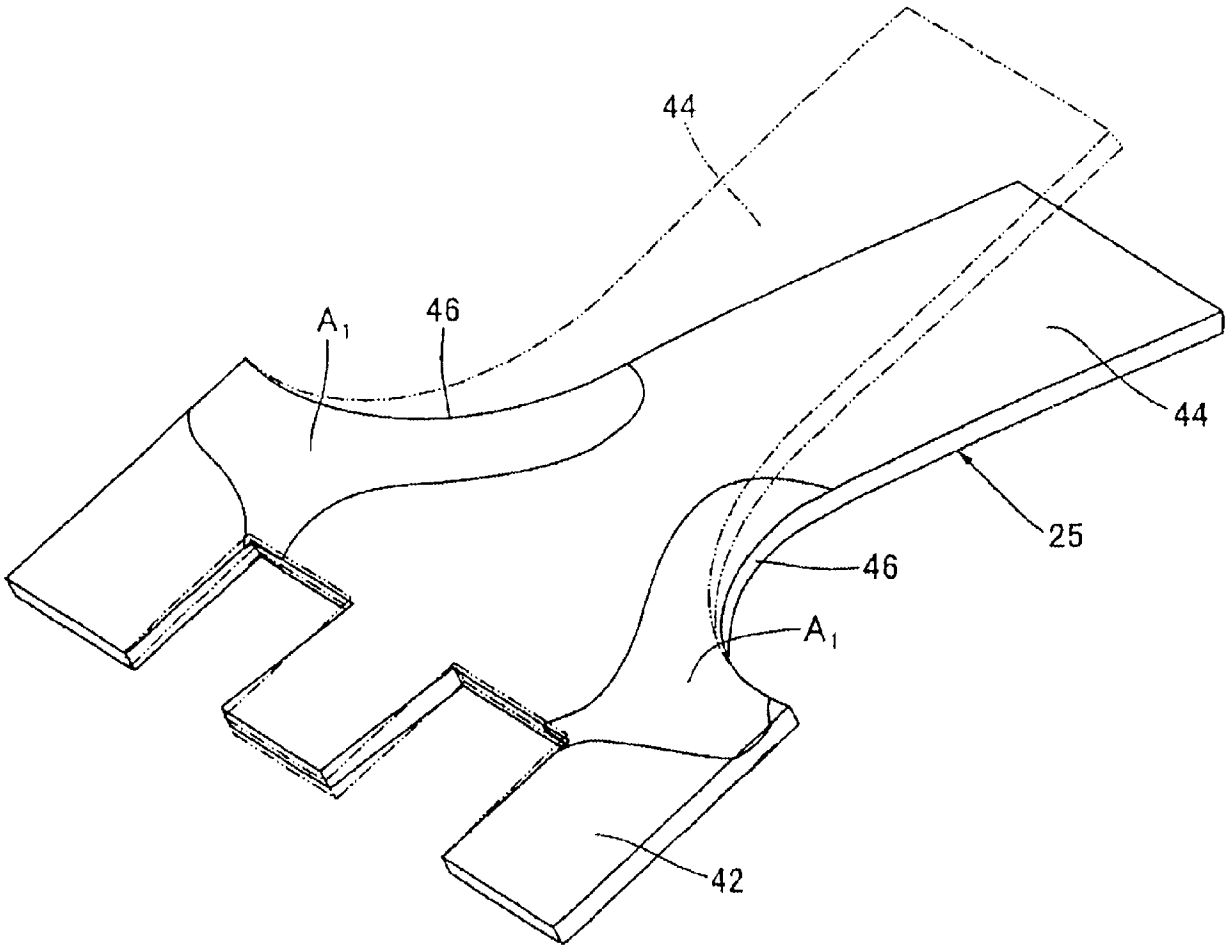
FIGS. 5–6 are perspective views of modified movable terminals showing stress distributions.
Figure 6:
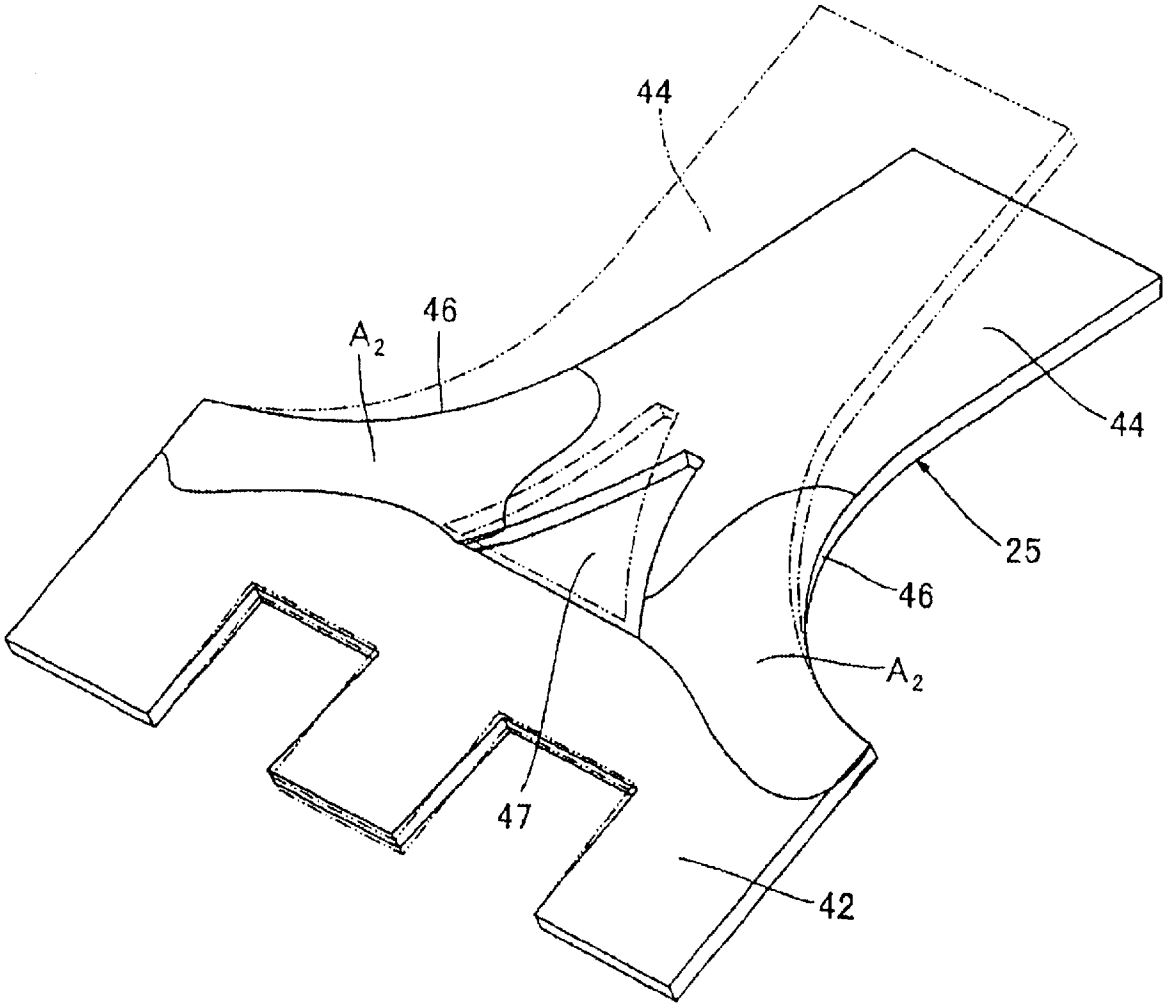

In FIG. 5, when the side faces 46 are a quarter circular arc with a diameter of substantially L, the relatively high stress is distributed to a larger areas $A_1$ along the side faces 46, and the maximum stress is less than ⅓ of that of the case in FIG. 4 ($1.4\times10^3$N/mm$^2$). In FIG. 6, since the cut-off portion 47 is provided in the flexible portion 44 at a position located on a side of the fixed portion 42 with respect to the point P, the relatively high stress is distributed to a further larger areas $A_2$ extending from the side faces 46 to the cut-off portion 47 and its maximum stress is reduced to the minimum. That is, when the curvature is provided to the side faces 46, the stress on the flexible portion 44 is distributed to a larger area along the side faces 46, and when the cut-off portion 47 is provided along the side faces 46, the stress is distributed to a further larger area and the maximum value of the stress is further reduced.

In the above embodiment, the curvature of the side faces 46 is a quarter arc. However, the curvature may be a ⅛ arc having a diameter of 2L, or by a part of an oval.

Figure 7:
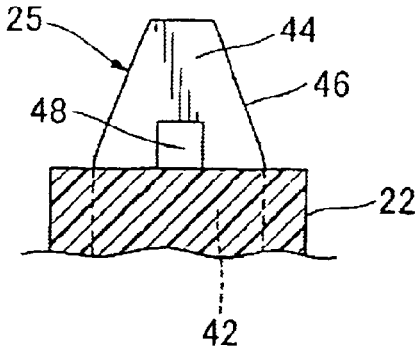
FIGS. 7–10 are schematic top plan views of different movable terminals according to the embodiment.
Figure 8:
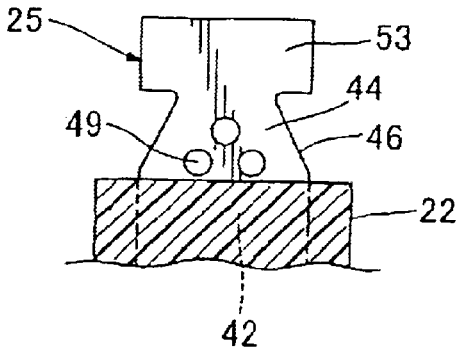
Figure 9:
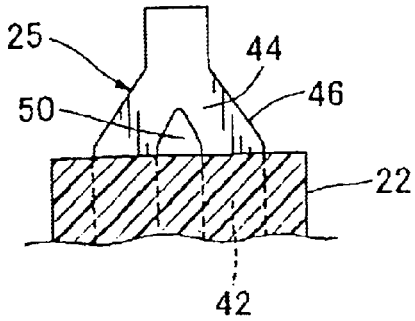
Figure 10:
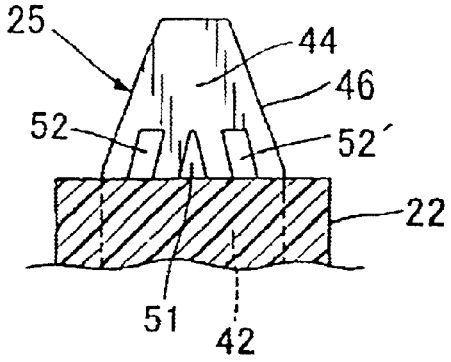
Figure 11:
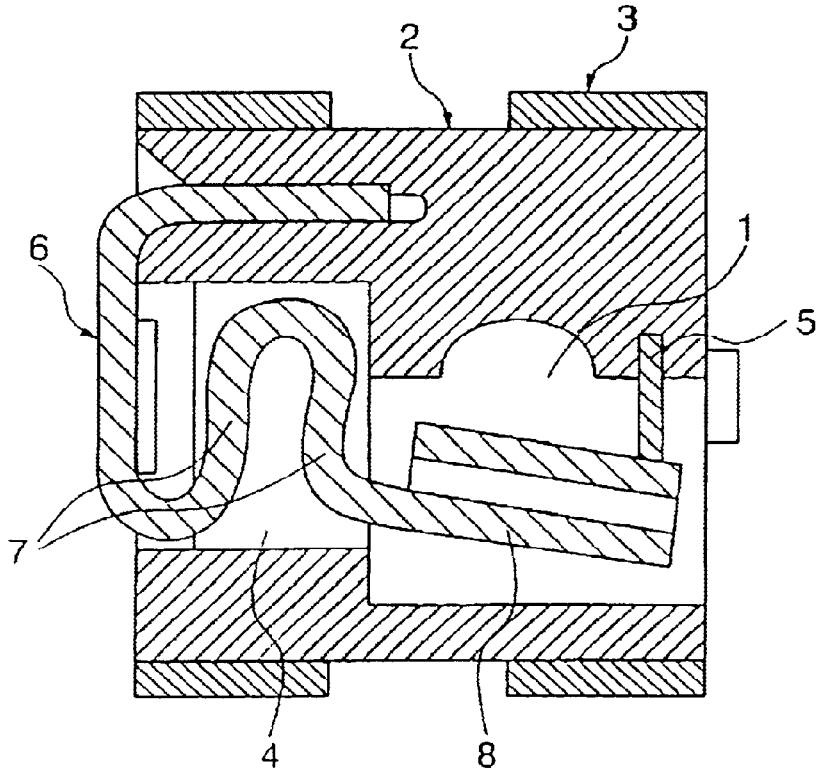
FIG. 11 PRIOR ART
FIGS. 11–12 are sectional views of a coaxial connector according to the prior art taken in a horizontal plane.
Figure 12:
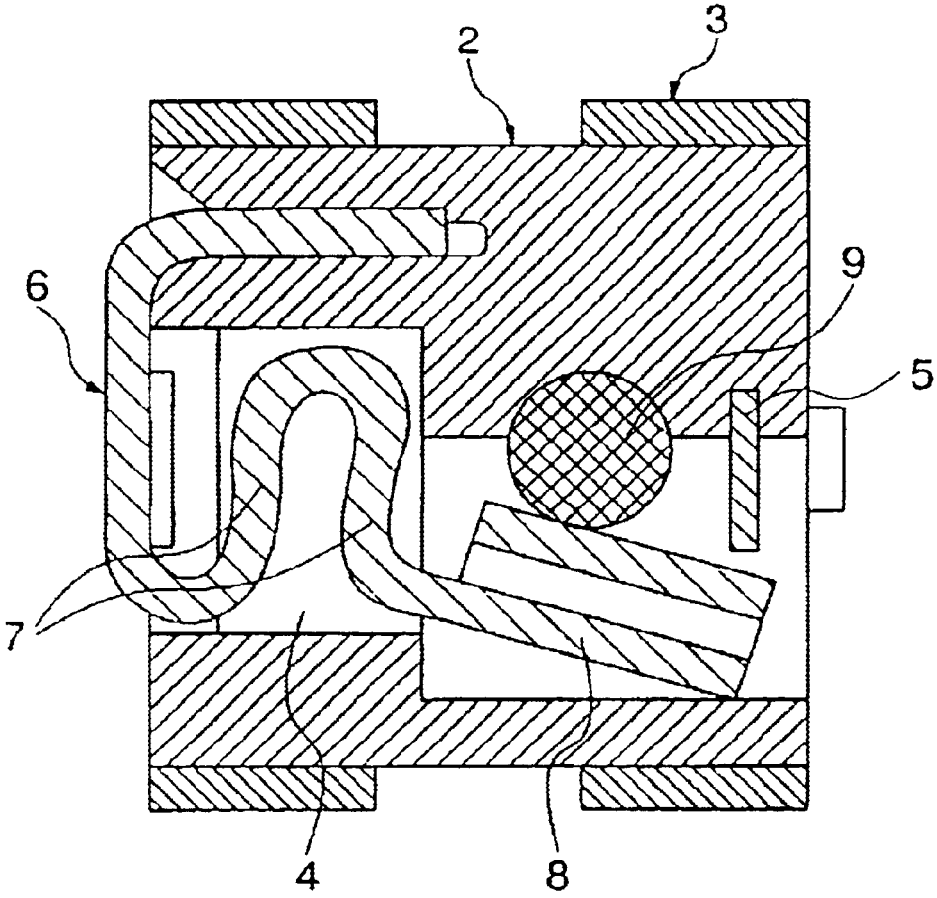
FIG. 12 PRIOR ART
Figure 13:
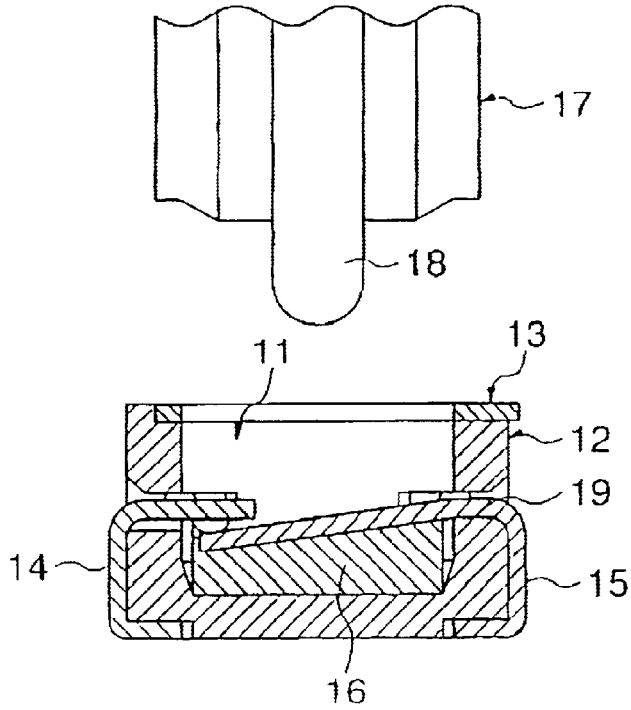
FIG. 13 PRIOR ART
FIGS. 13–14 are sectional views of another coaxial connector according to the prior art.
Figure 14:
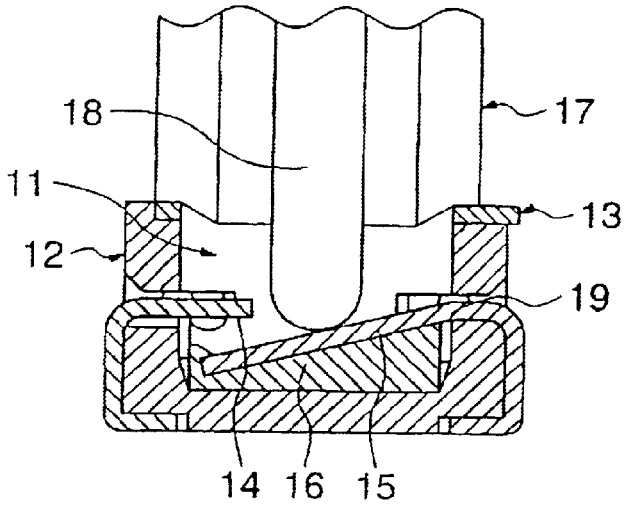
FIG. 14 PRIOR ART

The shape of the cut-off portion 47 is not limited to the shape described above. In FIG. 7, for example, a rectangular cut-off portion 48 is provided. In FIG. 8, three circular cut-off portions 49 are provided at vertexes of a triangle. In FIG. 9, a triangular cut-off portion 50 extends up to the fixed portion 42. In FIG. 10, two parallelograms 52 and 52' are provided on opposite sides of a triangular cut-off portion 51. It is preferable that the cut-off portions are preferably formed along the side faces 46. The cut-off portion 50 may be extended up to the vicinity of a base of the board connection portion 43 so that high stress is not transmitted to the board connection portion 43, thus preventing the deterioration of a connection section with the circuit board.

Also, it is not necessary that the arm portions 41 are provided in the movable terminal 25 as long as the arm portions 41 cover the spaces 54 on the sides of the flexible portion 44. For example, in FIG. 8, an end of the flexible portion 44 is extended to right and left sides. Alternatively, both sides of the fixed portion 42 of the movable terminal 25 may extend toward a top end of the movable terminal 25.

According to the invention, the stress on the movable terminal during the elastic deformation of the movable terminal is dispersed and reduced so that the durability of the movable terminal is increased. Even if the movable terminal is made short or a simple form, a desired elastic force is obtained so that the high-frequency property is improved and the product is miniaturized. The number of parts is minimized so that the manufacturing process is simplified, thus minimizing the manufacturing cost. In addition, since the arm portions are provided at such positions that the spaces on sides of the flexible portion are covered by the arm portions, the distances from the outer conductor to the fixed terminal and to the movable terminal are substantially equal to each other, resulting in the excellent high-frequency characteristics.

What is claimed is:

1. A coaxial connector with a switch to be mounted on a board, comprising:

an insulative housing having an opening for receiving a central conductor of a coaxial plug;

an outer conductor provided outside said insulative housing and engaging with an outer conductor of said plug such that said coaxial plug is attached to or detached from said coaxial connector;

a fixed terminal provided under said opening and having a contact portion;

a movable terminal provided under said opening and having a fixed portion fixed to said insulative housing and a cantilevered flexible portion extending from said fixed portion and contacting with said contact portion of said fixed terminal, wherein when said central conductor of said coaxial plug is plugged into said opening of said insulative housing, said central conductor of said coaxial plug abuts against said flexible portion so that said flexible portion separates from said contact portion of said fixed terminal to switch a signal circuit, and said flexible portion comprises at least one cut-off portion at a position located on a side of said fixed portion with respect to an abutting position with said central conductor of said coaxial plug, wherein said flexible portion comprises side faces between which a distance increases from a vicinity of said abutting position toward said fixed portion of said movable terminal and said cut-off portion has a shape formed along said side faces.

2. The coaxial connector with a switch according to claim 1, wherein said cut-off portion has a substantially triangular shape.

3. The coaxial connector according to claim 1 or 2, said side faces are curved from said vicinity of said abutting position toward said fixed portion of said movable terminal in a concave form.

4. A coaxial connector with a switch to be mounted on a board, comprising:

an insulative housing having an opening for receiving a central conductor of a coaxial plug;

an outer conductor provided outside said insulative housing and engaging with an outer conductor of said plug such that said coaxial plug is attached to or detached from said coaxial connector;

a fixed terminal provided under said opening and having a contact portion; and a movable terminal provided under said opening and having a fixed portion fixed to said insulative housing and a cantilevered flexible portion extending from said fixed portion and contacting with said contact portion of said fixed terminal, wherein when said central conductor of said coaxial plug is plugged into said opening of said insulative housing, said central conductor of said coaxial plug abuts against said flexible portion so that said flexible portion separates from said contact portion of said fixed terminal to switch a signal circuit, and said flexible portion comprises side faces curved from a vicinity of an abutting position with said central conductor of said coaxial plug toward said fixed portion of said movable terminal in a concave form.

5. The coaxial connector with a switch according to claim 4, wherein each of said side faces of said flexible portion is formed by a quarter circular arc having a diameter of substantially ½ to 2 times of a difference between a width of said flexible portion at said vicinity of said abutting position and a width of said fixed portion of said movable terminal.

6. A coaxial connector with a switch to be mounted on a board, comprising:

an insulative housing having an opening for receiving a central conductor of a coaxial plug;

an outer conductor provided outside said insulative housing and engaging with an outer conductor of said plug such that said coaxial plug is attached to or detached from said coaxial connector;

a fixed terminal provided under said opening and having a contact portion and a fixed portion; and a movable terminal provided under said opening and having a fixed portion fixed to said insulative housing and a cantilevered flexible portion extending from said fixed portion and contacting with said contact portion of said fixed terminal, said fixed portions of said fixed and movable terminals having substantially same width which is greater than a width of said flexible portion of said movable terminal, and at least one of said fixed and movable terminals comprising an arm portion to cover a space on both sides of said flexible portion.

* * * * *